US006307482B1

(12) United States Patent
Le Bel

(10) Patent No.: US 6,307,482 B1
(45) Date of Patent: Oct. 23, 2001

(54) SILENCEABLE SPEAKER WITH PRE-ANNOUNCE TONE DETECTION

(75) Inventor: Vincent Victor Le Bel, Tara (CA)

(73) Assignee: SPX Corporation, Muskegon, MI (US)

( * ) Notice: Subject to any disclaimer, the term of this patent is extended or adjusted under 35 U.S.C. 154(b) by 0 days.

(21) Appl. No.: 09/687,154

(22) Filed: Oct. 12, 2000

Related U.S. Application Data

(60) Provisional application No. 60/159,280, filed on Oct. 13, 1999.

(51) Int. Cl.[7] ..... G08B 3/00

(52) U.S. Cl. ..... 340/691.8; 340/693.4; 340/630; 340/628; 340/521; 340/326; 340/309; 381/82; 381/77

(58) Field of Search ..... 340/691.8, 692, 340/693.4, 309.3, 630, 521, 326, 628, 309.11, 311.2, 384.5, 384.7; 381/82, 77

(56) References Cited

U.S. PATENT DOCUMENTS 4,438,428 * 3/1984 Ober et al. ..... 340/521
4,477,798 * 10/1984 Saul et al. ..... 340/527
4,702,614 * 10/1987 Copley et al. ..... 368/72
5,422,629 * 6/1995 Minnis et al. ..... 340/630
5,812,054 * 9/1998 Cohen ..... 340/506

* cited by examiner

*Primary Examiner*—Jeffery Hofsass
*Assistant Examiner*—Tai T. Nguyen
(74) *Attorney, Agent, or Firm*—Pepper Hamilton, LLP

(57) ABSTRACT

An alarm signaling device (5) operable to produce an alarm signal and, possibly, communicate emergency announcements when triggered by a signal from a central alarm control panel. The alarm includes a speaker or other sound producing device and a silencing circuit (14) that can be engaged by a person in the room to temporarily disable the speaker. The silencing circuit includes a timing circuit (30) and a switch (32) consisting of a pair of touch contacts (38, 40) that are activated by body resistance. The timing circuit (30) is operable to automatically re-enable the speaker after a predetermined time period has been measured. Furthermore, though the speaker has been silenced by the silencing circuitry (14), a reactivation circuit (15) continues to receive and process signals in order to identify a re-enablement signal by its particular frequency and duration. Once the re-enablement signal has been identified, the reactivation circuit (15) automatically overrides the silencing circuit (14) so that alarm signals or emergency announcements may be communicated.

16 Claims, 3 Drawing Sheets

SILENCEABLE SPEAKER WITH PRE-ANNOUNCE TONE DETECTION

RELATED APPLICATIONS

This application claims priority benefit, with regard to all common subject matter, of provisional application entitled A Silenceable Speaker With Pre-Announce Tone Detection, Ser. No. 60/159,280, filed Oct. 13, 1999. The identified provisional application is hereby incorporated into the present application by reference.

BACKGROUND OF THE INVENTION

1. Field of the Invention

The present invention relates to alarm signaling devices for mounting in rooms or other interior areas and coupled to a central alarm control panel. More particularly, the invention relates to an alarm having both a speaker for communicating emergency announcements and an associated silencing circuit operable to temporarily disable the speaker until either a predetermined amount of time has expired or an overriding re-enablement signal is received.

2. Description of the Prior Art

Fire and other alarm systems typically include both a plurality of remote alarms and a central alarm control panel, with the panel being electrically coupled with the remote alarms for controlling the operation thereof. When the alarm control panel or any sensors associated therewith sense a fire or other alarm condition, the control panel triggers the remote alarms. Some such remote alarms include speakers operable to communicate emergency announcements related to the alarm condition.

It is often desirable, however, to silence a particular remote alarm without deactivating or resetting the entire alarm system. For example, during testing of a fire alarm system, persons in a particular room not participating in the test may wish to temporarily silence the alarm located in that room.

Unfortunately, when conditions change and it becomes desirable to trigger a second alarm or, if the system so allows, to communicate an emergency announcement, a silenced alarm may prevent the signal or important announcement from being heard.

SUMMARY OF THE INVENTION

The present invention solves the above-described problems and provides a distinct advance in the art of alarm signaling devices. More particularly, the present invention provides an alarm having a speaker or other sound producing device operable to communicate an alarm signal or emergency announcement, but which can be temporarily silenced and automatically re-enabled.

The silencing circuit preferably includes a switch-triggered timing circuit for disabling the speaker for a predetermined amount of time. The switch preferably comprises a pair of spaced-apart touch contacts that are activated by body-resistance. Specifically, the contacts trigger the timing circuit when a person in the room simultaneously touches both the contacts with one or more of his or her fingers. If no other action is taken, the speaker automatically re-enables after the expiration of the timed period.

A special re-enabling, or "pre-announce", signal sent from the central control panel will override the silencing circuit and re-enable the speaker before the timed disable period has expired. The reactivation circuitry preferably includes a bandpass filter and timer to identify the particular frequency and duration indicative of the re-enablement signal. Once the signal is identified, the reactivation circuitry overrides the silencing circuit and re-enables the speaker or other sound producing device without regard for the timing circuit.

BRIEF DESCRIPTION OF THE DRAWING FIGURES

A preferred embodiment of the present invention is described in detail below with reference to the attached drawing figures, wherein.

DETAILED DESCRIPTION OF A PREFERRED EMBODIMENT

Figure 1:
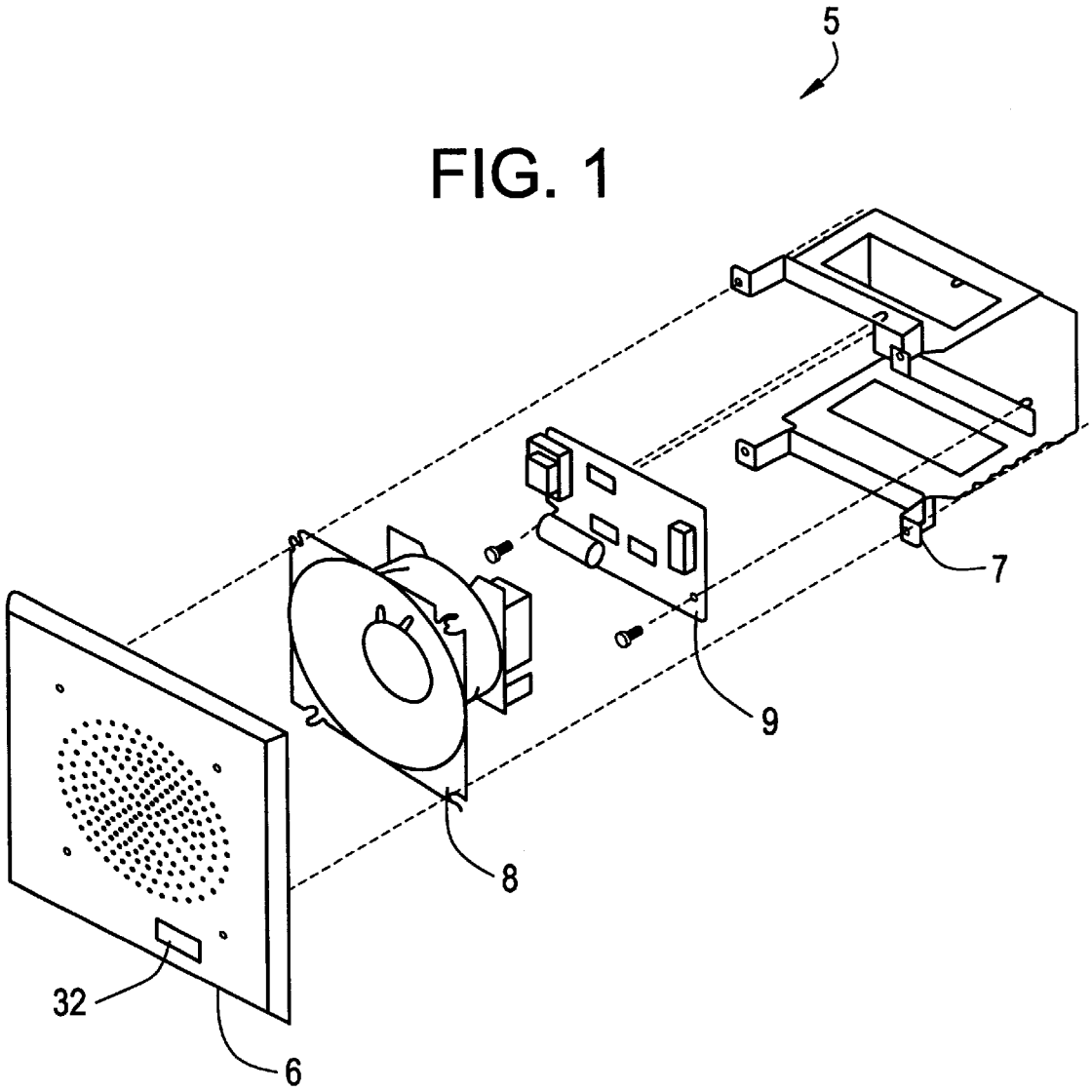
FIG. 1 is an exploded perspective view of an alarm signaling device constructed in accordance with a preferred embodiment of the present invention.

Referring first to FIG. 1, a fire alarm signaling device 5 constructed in accordance with a preferred embodiment of the present invention is illustrated configured for mounting in a room or other interior space monitored by a conventional fire alarm control panel (not shown). Several of the alarms 10 may be located in different rooms or spaces of a building and all coupled with the same control panel. The preferred alarm 5 broadly comprises a faceplate 6; a box 7; a speaker 8; and electronic circuitry 9.

The faceplate 6 protectively covers the speaker 8 and electronic circuitry 9 and provides a mounting surface for various controls and indicators described below. The face plate 6 also includes slots or holes for permitting sound from the speaker 8 to emit therethrough. The box 7 protectively and supportively houses the speaker 8 and electronic circuitry 9. The speaker 8 is operable, when driven by the control panel and enabled by the electronic circuitry 9, to communicate an alarm signal or an emergency announcement. The faceplate 6, box 7, and speaker 8 are conventional.

Figure 2:
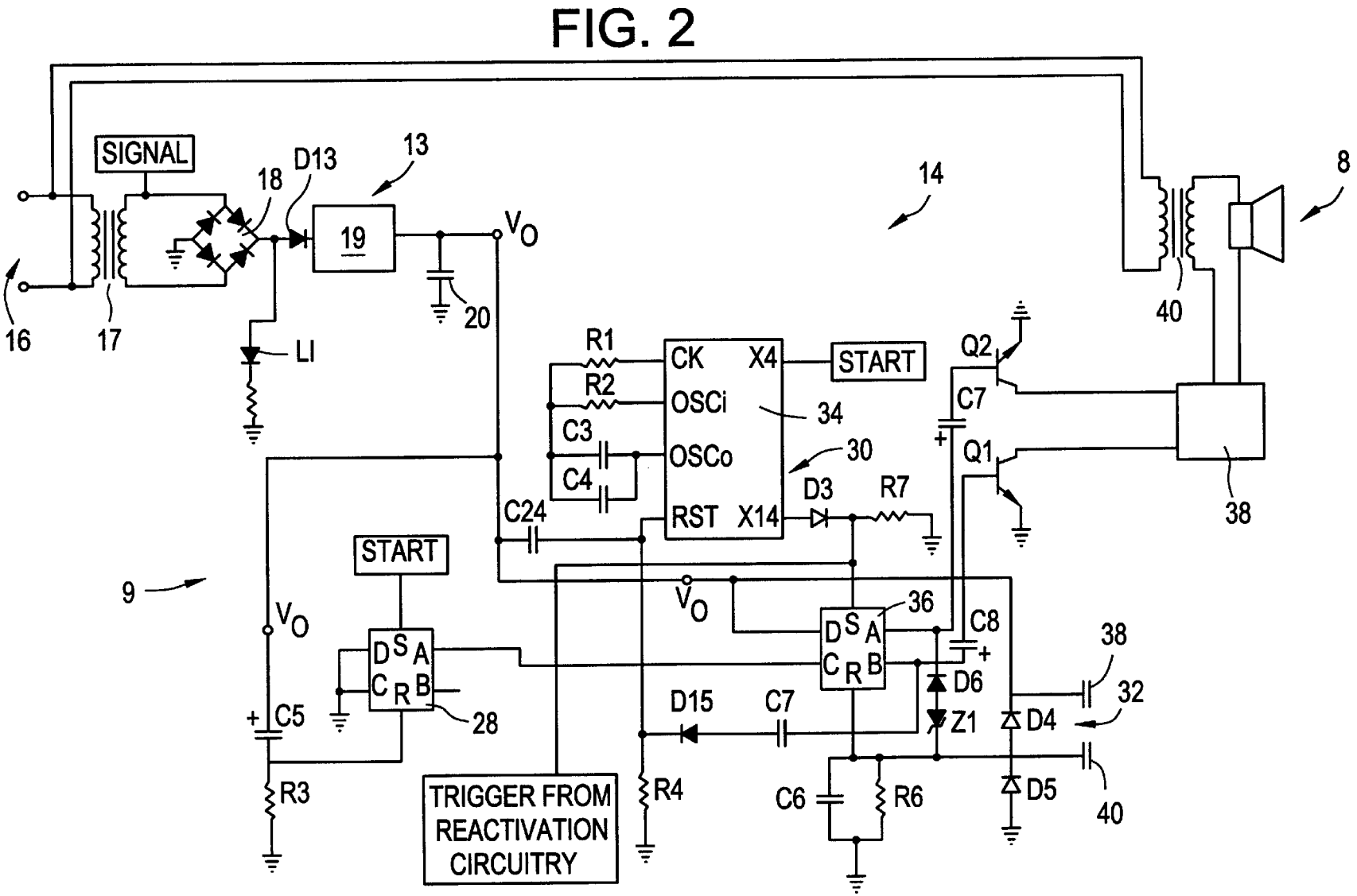
FIG. 2 is a circuit diagram of a first portion of the electronic circuitry of a preferred embodiment of the present invention.
Figure 3:
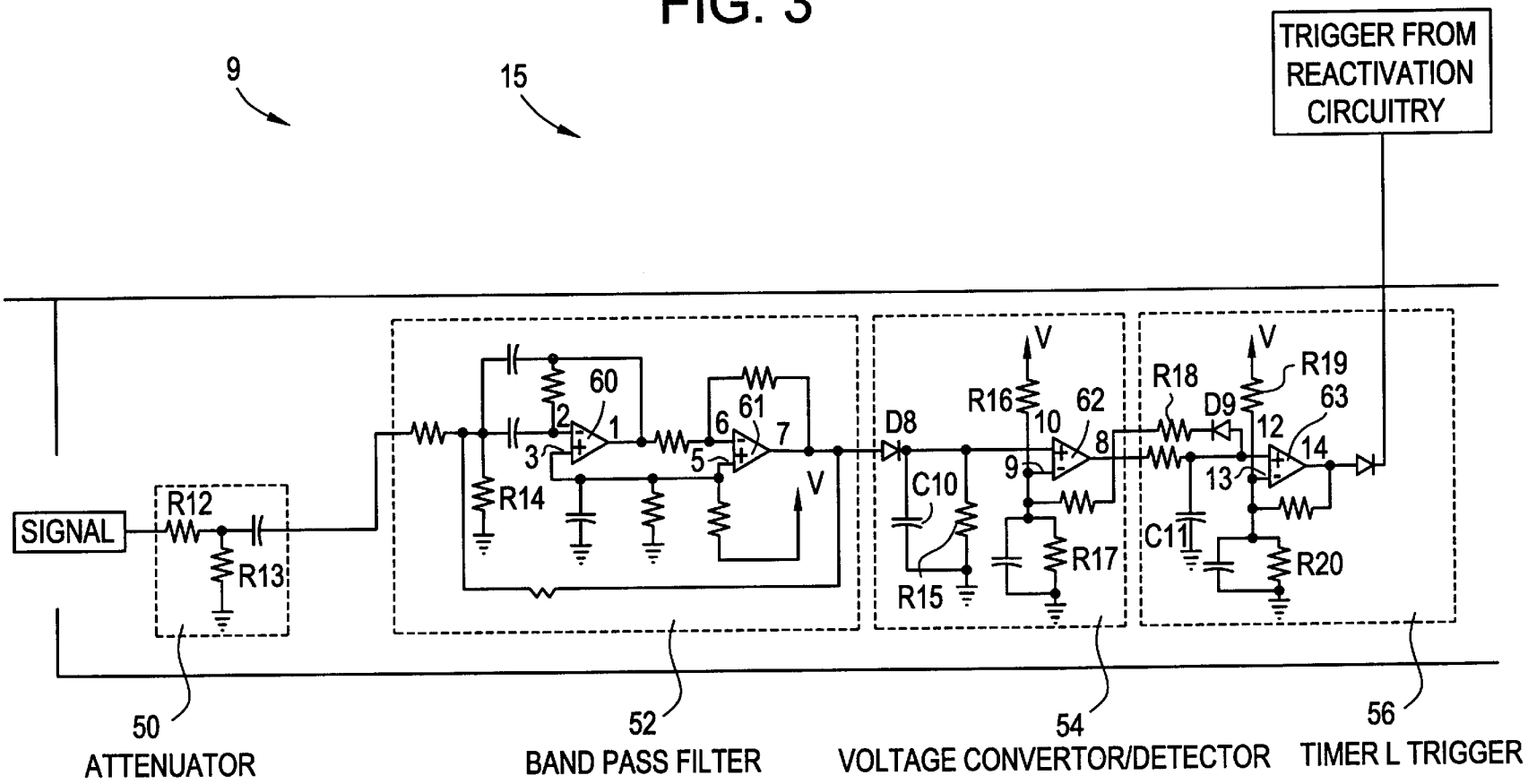
FIG. 3 is a circuit diagram of a second portion of the electronic circuitry of the present invention.

As illustrated in FIGS. 2 and 3, the electronic circuitry 9 is operable to control enablement of the speaker 8, and broadly comprises power supply circuitry 13; silencing circuitry 14; and re-activation circuitry 15. More specifically, FIG. 2 illustrates the power supply circuitry 13 for delivering power to the remaining electronic components of the alarm 5, and the silencing circuitry 14 for controlling disablement of the speaker 8.

The power supply circuitry 13 comprises signal connection terminals 16; a step-down transformer 17; a bridge rectifier 18; a voltage regulator 19; and a capacitor 20. The signal connection terminals 16 receive both signals and power from the control panel via a 70 Vrms audio line (not shown). The transformer 17 steps-down the 70 Vrms signals and power to a useable 25 Vrms, which is then fully rectified by the full-wave bridge rectifier 18.

The ultra low current precision voltage regulator 19 is included to provide the degree of voltage regulation necessary for proper operation of certain sensitive components, including various logic devices described below.

A light emitting diode (LED) L1 is included to provide a visual indication of the alarm condition. That is, when signals are received at the terminals 16 indicating an alarm condition, L1 lights and remains lit until the signals cease.

The capacitor 20 follows the regulator 19 and, when fully charged, is operable to provide sufficient power to the remaining circuit such that brief (approximately 3 to 4 seconds) disruptions in power will have no adverse effects on the operation of the alarm 5. Blocking diode D13 prevents the capacitor 20 from discharging through LED L1 in the absence of power.

The electronic circuitry 14 includes a resistor R3 (82 K ohm), a capacitor C5 (4.7 uF, 35 v), and a latch 28 (MQ4013 or CD4013B). The alarm 5 powers-up when signals are received at the terminals 16. Upon power-up, C5 and R3 operate in combination to reset the latch 28. This ensures that the output A of the latch 28 will power-up in a known LOW state so that the speaker 8 will always energize on power-up of the alarm 5. A diode D15 is included to block a potential instantaneous power-up short from the B pin of the latch 36 through C24.

The electronic circuitry 14 further includes both timing circuitry 30 and a switch 32 for triggering the timing circuitry 30. The timing circuitry 30 is operable to silence the speaker 8 when triggered and to permit the speaker 8 to operate normally following a predetermined time interval measured from the triggering of the timing circuit 30. The timing circuitry 30 broadly includes an oscillator/counter 34, a latch 36, two transistors Q1, Q2 (NPN 2N4401), and a latching relay 38.

The switch 32 is coupled with the timing circuitry 30 for triggering the oscillator/counter 34 and latch 36 when activated by a person in the room in which the alarm is located. One preferred location for the switch 32 is on the faceplate 6 as shown in FIG. 1. The switch 32 preferably comprises a pair of spaced-apart touch contacts 38,40 that trigger the oscillator/counter 34 and latch 36 when a person in the room places his or her finger thereacross. Specifically, the body resistance between a person's two fingers, which is in the order of three meg ohms, causes the switch 32 to change state to trigger the oscillator/counter 34 and latch 36. A pair of diodes D4 and D5 (both 1N4006) are connected between the touch contacts to minimize damage to the alarm caused by electrostatic discharges when a person touches the touch contacts 38,40. A capacitor C6 (1 uf) and a resistor R6 (10 MOhm) are connected between diodes D4 and D5 to minimize RF noise that may be introduced when a person touches the touch contacts and to prevent the latch reset input from floating.

The touch contacts 38,40 are preferably elongated, rod-shaped, nickel-plated pems or posts that protrude slightly through the front of the faceplate 6. The use of touch contacts 38,40 to form the switch rather than conventional mechanical switches reduces the cost and complexity of the alarm.

Alternatively, the switch 32 may be a resistive switch, push button, or any similar input device. Furthermore, the switch 32 need not be mounted on the faceplate 6 or even near the alarm 5. Where the alarm 5 is ceiling mounted, for example, or otherwise located such that activating a faceplate-mounted switch 32 would be difficult, the switch 32 may be remotely located in a more convenient location.

The oscillator/counter 34 is coupled with the switch 32 and the latch 36 and is operable to measure count a pre-established amount of time after it has been triggered by the switch 32. To that end, the oscillator component provides timing signals which the counter component counts. The RC time constant made up of C24 and R4 ensures that the oscillator/counter 34 always begins counting at its X4 pin.

The latch 36 provides signals to both transistors Q1,Q2. Because Q2 is connected to the A pin of the latch 36 and Q1 is connected to the B pin, only one transistor will receive a HIGH signal at any given point in the circuit's operation. The transistors Q1,Q2 control the latching relay 38 which is interposed between an audio transformer and the speaker 8.

The latching relay 38 includes normally closed contacts. That is, when Q2 receives a HIGH signal from the latch 36, the latching relay's contacts will close and the speaker will be enabled. When Q1 receives a HIGH signal, the latching relay's contacts will open and the speaker will be disabled.

When the oscillator/counter 34 powers-up, the oscillator component begins to count and pin X4 generates a START pulse up to ½ second after the counter component starts to function. This START pulse results in a pulse being generated from pin A of latch 36 causing latching relay 38 to RESET via transistor Q2. Q1 and Q2 are preferably capacitively coupled by capacitors C7 and C8 to latch 36 so as to minimize overall current consumption of the circuit.

The latching relay's normally closed contacts are connected between the speaker 8 and the speaker's audio transformer. Thus, by default, the speaker 8 will always be connected to the speaker's audio transformer 40 when the relay 38 is in the RESET state.

Diode D6 AND zener diode Z1 are included to address the case where switch 32 is shorted (15 kOhms or less) holding the latch 36 in the RESET state and possibly preventing the latching relay 38 from triggering to the RESET state. With the addition of D6 And Z1, a shorted switch 32 will cause the voltage signal to be applied to the base of transistor Q2, thereby forcing the relay 38 into operation.

At the expiration of the timed period, the oscillator/counter 34 triggers the latch 36 which triggers the latching relay to close its contacts and re-enable the speaker 8. To comply with fire codes, the silencing circuitry 22 must re-enable the speaker 8 within ten (10) minutes after it has been temporarily silenced. In the preferred embodiment, the speaker 8 is re-enabled within approximately 7.5 minutes. Therefore, the oscillator frequency of the oscillator/counter 34 is selected to be 18 Hz±3 Hz so that the counter 34 reaches its maximum count value between 6.5 minutes and 9.1 minutes, which is centered near 7.5 minutes.

The timing circuitry 30 of the present invention is superior to prior art timing capacitors and discrete semiconductors. To meet fire system standards, the timing circuitry 30 must be accurate to within ±1.5 minutes and be capable of such accurate timing over a temperature range of 0° C. to 49° C. The oscillator/counter integrated circuit 34 and other components of the timing circuitry 30 of the present invention easily meet these standards and are more reliable and stable than prior art timing circuitry.

Referring to FIG. 3, the reactivation circuitry 15 re-enables the speaker 8 upon receipt and identification of the re-enablement signal, regardless of whether or not the timed disable period provided for by the timing circuitry 30 has expired. The re-enablement signal is sent from the central control panel. The reactivation circuitry 15 overrides the timing circuitry 30 in the sense that it is able to bypass the timing circuitry 30 to SET the latch 36 and thereby re-enable the speaker 8 early.

The reactivation circuitry 15 comprises attenuator circuitry 50; bandpass filter circuitry 52; voltage converter/detector circuitry 54; and timer and trigger circuitry 56. The reactivation circuitry 15 continues to receive signals even though the speaker 8 has been disabled by the timing circuitry 30.

The attenuator circuitry 50 is operable to attenuate the input signal to the bandpass filter 52 so as not to overdrive the filter circuitry. The degree of attenuation is determined by resistors R12 and R13.

The bandpass filter circuitry 52 is operable to pass signals having a particular frequency. The preferred frequency is application specific. The description of the present invention is based upon a preferred frequency of 915 Hz. The bandpass circuitry 52 comprises two operational amplifiers 60,61, each being a two-pole bandpass filter with a center frequency set at 915 Hz, or some other preferred frequency, as determined by resistor R14. The overall gain of the two cascaded amplifiers 60,61 is 17.

The voltage converter/detector circuitry 54 is operable to both convert the signal to a DC level and to provide a charging signal to the timing circuitry 56. Diode D8 and capacitor C10 convert the output of the bandpass filter circuitry 52 to a DC level. Resistor R15 keeps capacitor C10 discharged and matches the output of the converter stage to the detector stage. The output of the converter stage is proportional to the frequency of its input signal.

Operational amplifier 62 converts the DC level to a signal that switches only when the level is greater than one-half the supply voltage, as determined by resistors R16 and R17. When the output of the amplifier 62 is High, an acceptable range of frequencies (792 Hz–1096 Hz) have been allowed through to the timer circuitry 56.

The timer and trigger circuitry 56 is operable to measure the duration of the signal and, if the duration matches the predetermined duration of the re-enablement signal, trigger the re-enablement of the speaker 8. The time required to charge capacitor C11 determines the required signal duration, which is application specific. The description of the present invention is based upon a preferred signal duration is 1.5 to 2 seconds.

If the output of the amplifier 62 goes Low because the input signal exceeds the bandpass filters' range, then capacitor C11 is immediately discharged by diode D9, thereby indicating that the signal was not the re-enablement signal. Resistor R18 prevents damage to the amplifier 62 during such discharge.

Once capacitor C11 charges sufficiently to overcome the reference voltage of resistors R19 and R20, comparator 63 generates a trigger signal causing the latch 36 to RESET, thereby re-enabling the speaker 8. The reference voltage was chosen so as to provide some hysteresis for signal inputs when sweeping frequencies are applied.

In operation, the speaker 8 normally sounds and the LED L1 is lit whenever the terminals 16 of the power supply circuitry 13 receive an alarm or announcement signal from a central fire alarm control panel. If a person in the room in which the alarm 5 is located wishes to silence the speaker 8, he or she may touch the touch contacts 38,40 that extend through the face plate 44 of the alarm 5. Body resistance between the person's fingers completes a circuit between the touch contacts 38,40 to RESET the latch 36.

Resetting the latch 36 causes it's a pin to go LOW, thereby applying power to transistor Q1 which causes the latching relay's normally closed contacts to open and the speaker 8 to disconnect from its audio transformer 40.

Resetting the latch 36 also causes its $\overline{Q}$ pin to go HIGH, which resets the oscillator/counter 34 so that the oscillator/counter 34 begins a counting sequence. When the oscillator/counter 34 reaches its maximum count value, which is preferably selected to be approximately 7.5 minutes, its X14 pin generates an output signal to set the latch 36. This causes its A pin to go HIGH and re-enables the speaker 8 so that the speaker 8 may once again sound. If the speaker 8 resounds, a person in the room may once again touch the touch contacts to reinitiate the silencing function. The LED L1 remains lit during an entire alarm condition to provide a silent indication of the alarm.

Signals continue to be received by the alarm 5 even though the speaker 8 has been silenced by activation of the timing circuit 30. Specifically, the reactivation circuitry 15 receives and processes incoming signals in order to identify the proper re-enablement signal by its particular frequency and duration, or some other signal characteristic. One contemplated reactivation signal, for example, would have a frequency of either 915 Hz or 2 kHz and a duration of between 1.5 to 2 seconds. The reactivation signal is sent from the control panel immediately prior to initiating an alarm signal or sending an emergency announcement possibly related to an existing alarm condition. Thus, those sending the signal or announcement are assured that any potentially silenced alarms 10 will be re-enabled and communicate the new alarm or announcement.

If the re-enablement signal is identified, the latch 36 is SET causing the latching relay's normally closed contacts to close and re-enabling the speaker 8 regardless of whether or not the oscillator/counter 34 has reached its maximum count value.

Although the invention has been described with reference to the preferred embodiment illustrated in the attached drawing figures, it is noted that equivalents may be employed and substitutions made herein without departing from the scope of the invention as recited in the claims. In particular, the present invention is for disabling and re-enabling a sound producing device that may, though not necessarily, be associated with an alarm. Although the sound producing device has been described herein as a speaker, the alarm may alternatively or additionally include a piezoelectric buzzer, horn, tone or chime generator, etc., also coupled to and regulated by the silencing/reactivation circuitry.

Having thus described the preferred embodiment of the invention, what is claimed as new and desired to be protected by Letters Patent includes the following:

1. A silenceable communication system receiving signals from a signal source, the silenceable communication system comprising:

a sound producing device coupled with driver circuitry, the driver circuitry receiving the signals, the sound producing device being operable in combination with the driver circuitry to produce sound in response to the signals;

a silencing circuit coupled with the driver circuitry and operable to temporarily decouple the sound producing device from the driver circuitry such that no sound is produced by the sound producing device, the silencing circuit comprising an input device operable to provide input;

a timing circuit operable in response to the input to produce a de-activation signal for decoupling the sound producing device from the driver circuitry such that no sound is produced by the sound producing device, the timing circuit being further operable to measure a pre-established period of time and then produce a reactivation signal for re-coupling the sound producing device to the driver circuitry; and a latch operable in response to the de-activation signal to decouple the sound producing device from the driver circuitry, and in response to the reactivation signal to re-couple the sound producing device to the driver circuitry; and a reactivation circuit coupled to the silencing circuit and operable to re-couple the sound producing device with the driver circuitry upon receipt and identification of a pre-announce signal sent by the signal source, the pre-announce signal having at least one particular identifying characteristic, the reactivation circuit comprising circuitry operable to identify the pre-announce signal by its particular identifying characteristic.

2. The silenceable communication system of claim 1, the sound producing device being a speaker.

3. The silenceable communication system of claim 1, the input device being a switch.

4. The silenceable communication system of claim 3, the switch comprising a pair of spaced-apart contacts operable to trigger the timing circuit when the contacts are closed, as by the fingers of a person simultaneously touching both contacts.

5. The silenceable communication system of claim 1, the timing circuit comprising an oscillator and a counter.

6. The silenceable communication system of claim 1, the particular identifying characteristics of the pre-announce signal being a particular identifying frequency and a particular identifying duration, the reactivation circuitry being operable to provide the reactivation signal to the latch when the pre-announce signal is identified, the reactivation circuitry comprising:

a filter operable to pass only those signals having the particular identifying frequency of the pre-announce signal; and a timer operable to pass only those signals having the particular identifying duration of the pre-announce signal.

7. A silenceable alarm coupled to a control panel, the control panel being operable to provide signals to the silenceable alarm, the silenceable alarm comprising:

a sound producing device coupled with driver circuitry, the driver circuitry receiving the signals, the sound producing device being operable in combination with the driver circuitry to produce sound in response to the audio signals;

a silencing circuit coupled with the driver circuitry and operable to temporarily decouple the sound producing device from the driver circuitry such that no sound is produced by the sound producing device; and a reactivation circuit coupled to the silencing circuit and operable to re-couple the sound producing device with the driver circuitry upon receipt of a pre-announce signal having at least one particular identifying characteristic.

8. The silenceable alarm of claim 7, the sound producing device being a speaker.

9. The silenceable alarm of claim 7, the silenceable alarm being powered only by the signals provided by the control panel.

10. The silenceable alarm of claim 7, the silencing circuit comprising:

an input device operable to provide input;

a timing circuit operable in response to the input to produce a de-activation signal for decoupling the sound producing device from the driver circuitry such that no sound is produced by the sound producing device, the timing circuit being further operable to measure a pre-established period of time and then produce a reactivation signal for re-coupling the sound producing device to the driver circuitry; and a latch operable in response to the de-activation signal to decouple the sound producing device from driver circuitry, and in response to the reactivation signal to re-couple the sound producing device to the driver circuitry.

11. The alarm of claim 10, the input device being a switch comprising a pair of spaced-apart contacts operable to trigger the timing circuit when the contacts are closed, as by the fingers of a person simultaneously touching both contacts.

12. The alarm of claim 10, the input device being a membrane switch comprising an integrated resistive button and light emitting diode.

13. The silenceable alarm of claim 7, the reactivation circuitry being operable to receive and identify the pre-announce signal, the pre-announce signal having a particular identifying frequency and a particular identifying duration, and to provide the reactivation signal to the latch when the pre-announce signal is identified, the reactivation circuitry comprising:

a filter operable to pass only those signals having the particular identifying frequency of the pre-announce signal; and a timer operable to pass only those signals having the particular identifying duration of the pre-announce signal.

14. The alarm of claim 13, the particular identifying frequency being 915 Hz.

15. The alarm of claim 13, the particular identifying frequency being 2 KHz.

16. The alarm of claim 13, the particular identifying duration being between 1.5 and 2 seconds.

* * * * *